US005307747A

United States Patent [19]

Mac Arthur

[11] Patent Number: 5,307,747

[45] Date of Patent: May 3, 1994

[54] HORIZONTAL FURNACE

[76] Inventor: Charles E. Mac Arthur, 5 High St., Box 355, Sangerville, Me. 04479

[21] Appl. No.: 29,180

[22] Filed: Mar. 10, 1993

[51] Int. Cl.[5] ..... F23B 7/00

[52] U.S. Cl. ..... 110/233; 110/235; 110/256; 110/315; 110/316

[58] Field of Search ..... 110/242, 235, 233, 256, 110/102, 241, 234, 315, 316

[56] References Cited

U.S. PATENT DOCUMENTS 4,253,406 3/1981 Spitz et al. ..... 110/242 X
4,782,767 11/1988 Stoner ..... 110/102 X
4,850,289 7/1989 Beausoleil et al. ..... 110/235

*Primary Examiner*—Edward G. Favors
*Attorney, Agent, or Firm*—Notaro & Michalos

[57] ABSTRACT

A low lying horizontal furnace comprising a fireproof enclosure sealed by a top burns solid fuels which are gravity fed through a vertical feed chamber positioned over a feed aperture in the top of the furnace. An exhaust stack is placed over an exhaust aperture spaced away from the feed aperture for venting exhaust gases from the furnace. Elongated fins are fixed to the underside of the top for channeling the exhaust gases from the feed aperture to the exhaust aperture. The horizontal furnace provides a field expedient furnace for cooking and heating for mass populations in that the top can be placed over a shallow pit dug into the ground for combusting solid fuels.

11 Claims, 6 Drawing Sheets

HORIZONTAL FURNACE

FIELD AND BACKGROUND OF THE INVENTION

The present invention relates in general to furnaces and in particular to a new and useful horizontal furnace for burning a plurality of solid fuels.

U.S. Pat. No. 4,836,115 discloses a vertical furnace for burning bio-mass solid fuels which comprises an upright cylindrical housing for feeding the solid fuel to a fire resistant vertical structure. Fuel is dropped onto the center of the floor of the structure through a central feed tube forming a truncated conical pile. The feed tube is surrounded by an air tube for providing a current of air downwardly to the burning fuel within the vertical structure. A surrounding heat exchanger utilizes water for heat transfer The vertical furnace is used to burn fuels such as plant materials, animal waste, wood, wood chunks, scrap wood, loose or hard or chipped wood, pressed sawdust, etc.

Presently, no known furnace exists that is horizontal with secondary air in a 360° circle on all sided and tangential to the fuel pile, and which burns solid fuels at a high Btu capacity.

SUMMARY OF THE INVENTION

The present invention provides for a horizontal furnace which is shallow and burns a solid fuel. Unlike the furnaces or heat exchangers found in the prior art, the present invention does not use water for heat exchange. The present invention comprises a fireproof enclosure sealed by a fireproof top. A feed chamber is fitted over a feed aperture in the top of the furnace for supplying fuel and air to the furnace. At a location spaced away from the feed chamber, an exhaust stack is placed over an exhaust aperture located within the top for venting exhaust gases from the furnace. The feed chamber has a lip with a plurality of openings for providing secondary air to the furnace in order to ensure proper burning of the fuel. Exhaust gases are channeled through channeling means, such as fins, from the feed aperture to the exhaust aperture for exit from the furnace.

The present invention allows for the fireproof top to be placed over a pit in the ground for providing a furnace that is field expedient with a high burning capacity for mass cooking or heating, which is applicable to many Third World countries.

It is an object of the present invention to provide a furnace that utilizes solid fuels in a horizontal or low lying enclosure.

It is another object of the present invention to provide a furnace which is portable and field expedient.

It is another object of the present invention to provide a furnace which has a high Btu capacity for burning solid fuels over a long period of time.

It is another object of the present invention to provide a horizontal furnace which does not utilize water for heat exchange.

It is another object of the present invention to provide a horizontal furnace which utilizes natural thermosiphon action.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
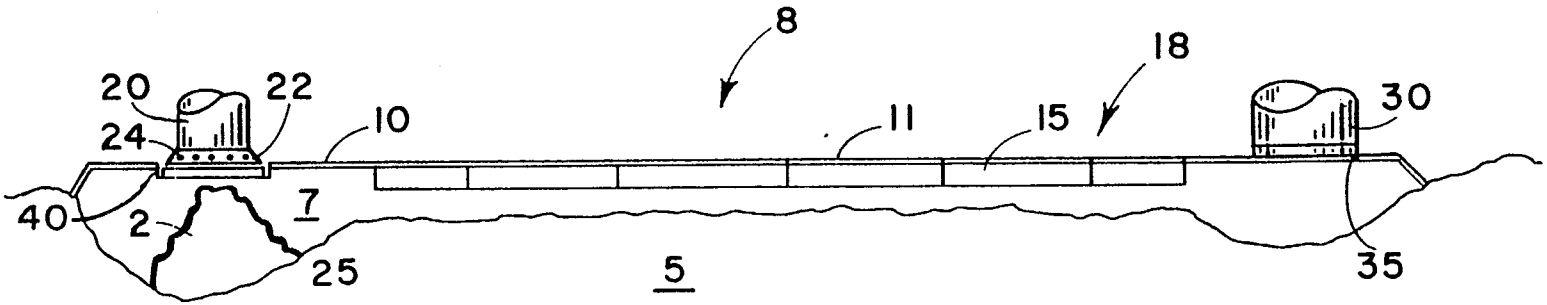
FIG. 1 is a side view, partly in section, of a horizontal furnace according to the present invention.
Figure 2:
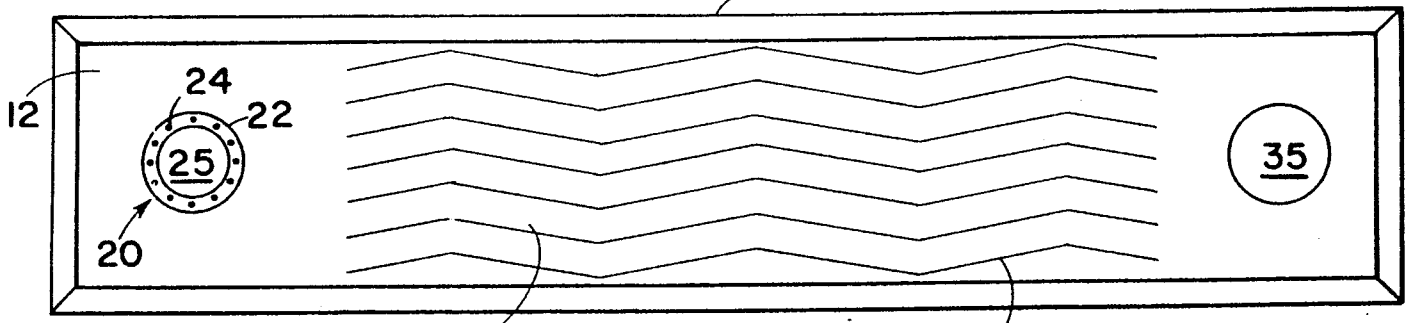
FIG. 2 is a bottom view of the furnace top of FIG. 1.

According to the present invention, FIGS. 1 and 2 illustrate a furnace, generally designated 8, comprising a fireproof top assembly 18 having a top 10. The top 10 is used to seal a horizontal low lying shallow enclosure 7. Enclosure 7 can be a pit or shallow depression dug into the ground or earth 5 as well as a low lying fireproof structure having a bottom and sides for providing a proper combustion environment, as used in following embodiments.

Solid fuel 2 is fed into enclosure 7 through a feed aperture 25 located within the top 10. A vertical feed chamber 20 is placed over the feed aperture 25 for feeding fuel 2 and air to enclosure 7. At a lower end or portion of the feed chamber 20, is a lip or rim 22 which is seated around the feed aperture 25. A plurality of openings such as holes or slits 24 are provided around the lip 22 for providing secondary air to the enclosure 7 for proper burning of the fuel 2.

The present invention also provides for a fire proof top 10 to be a plurality of plates 11 linked together for forming the fireproof top 10. Through the use of a fireproof top 10 that is continuous or is a plurality of linked plates 11, the field expedient furnace can be provided by placement over the pit in the ground 5. By providing a furnace 8 that is field expedient and portable mass feeding and heating can be supplied to many remote populations, e.g. Third World countries.

Feed chamber 20 has a feed tube 21 that can be circular, polygonal, square or tubular shaped for feeding fuel and air into enclosure 7. By gravity-feeding solid fuel through feed chamber 20, a conical fuel pile 2 collects beneath the feed aperture 25 for burning in a crucible or depressed crucible area of pit 7. Combustion air is provided for burning of the conical fuel pile 2 through apertures 24 in lip 22 of the feed chamber 20 as well as through the chamber 20.

Figure 3A:
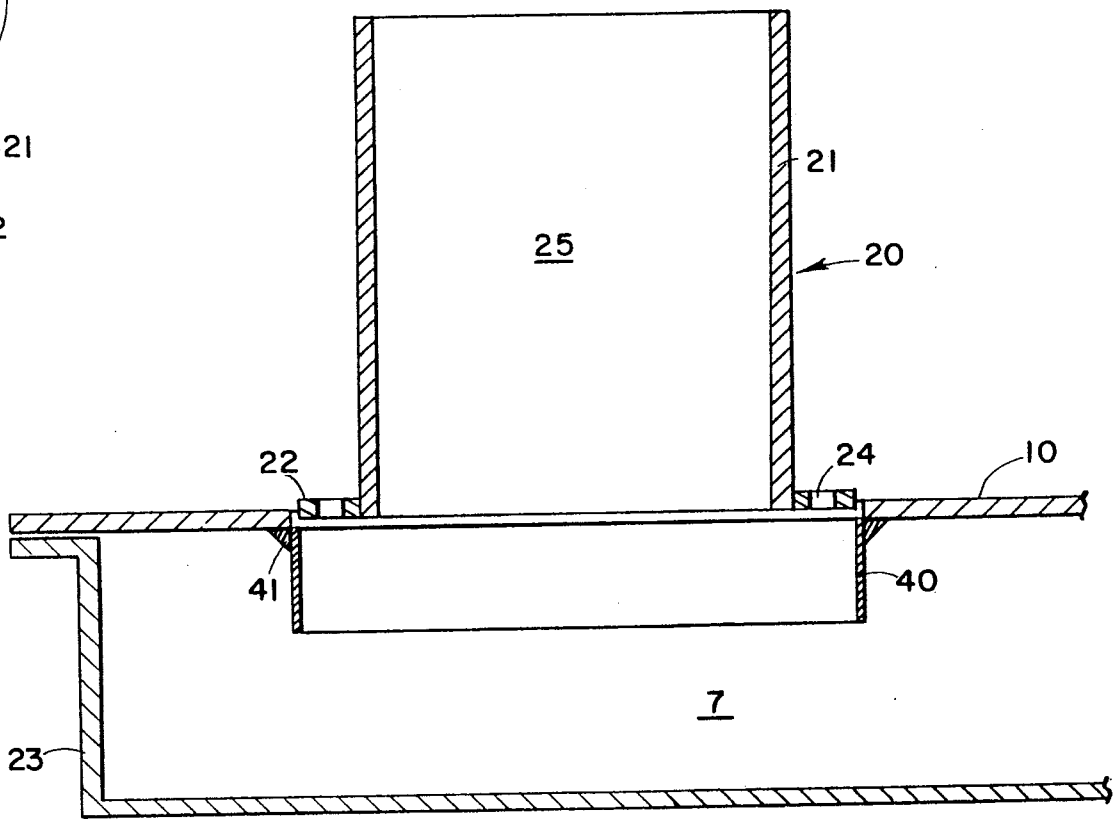
FIG. 3A is a side-sectional view of the feed chamber of FIG. 3, with portions of the furnace.
Figure 3:
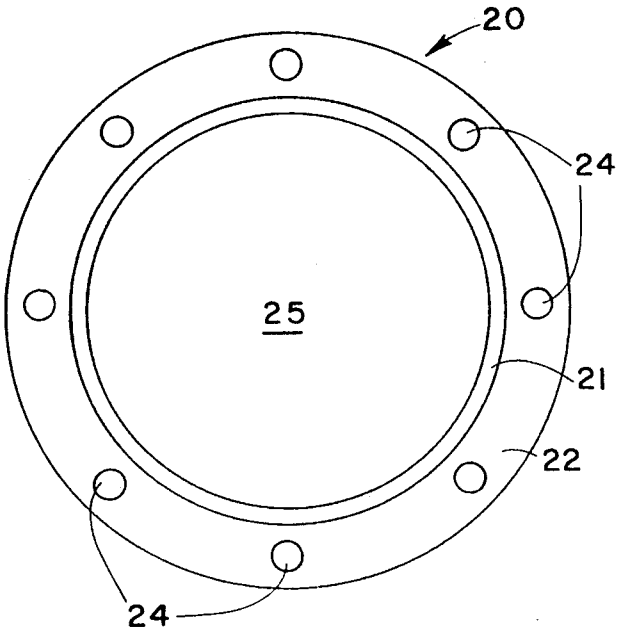
FIG. 3 is a top view of a feed chamber according to a second embodiment of the present invention.

An exhaust aperture 35 is also provided in top 10, spaced a distance away from the feed aperture 25. An exhaust stack 30 is provided over the exhaust aperture 35 for establishing a draft and ensuring the proper venting of exhaust gases from the enclosure 7. The inventor has found that the stack 30 can be as little as 48 inches tall and still produce sufficient draft so that all exhaust fumes and flames pass horizontally from the feed aperture to the exhaust aperture with no smoke or flame passing out of the furnace through the feed aperture or the secondary air holes 24. During start-up, before the full draft and thermosiphon has been established, the inventor has found that a short ring-shaped barrier or skirt 40 fixed to the top plate 10 and around the feed aperture prevents any smoke or flame from leaving the furnace through the feed aperture. A skirt as short as 1 inch or even as ½ to 3 inches will serve this purpose. For strength, the skirt can be attached by welding at fillet weld 41, to the top 10, as shown in FIG. 3A. The stack can be from 2 feet to any practical height and still function.

Within the furnace 8, exhaust channeling or diverting means 15 are used to channel exhaust gases from the feed chamber 25 to the exhaust aperture 35 for exiting the furnace 8. A plurality of elongated fins 15 can be fixed along an underside 12 of the top 10 for channeling the exhaust gases through channels 17 provided between fins 15. The exhaust channeling arrangement, as illustrated in FIG. 2, increased the path and contact time of the gases to the top 10, to heat up the top in an efficient manner. Fins 15 also prevent warping of top 10.

Figure 4:
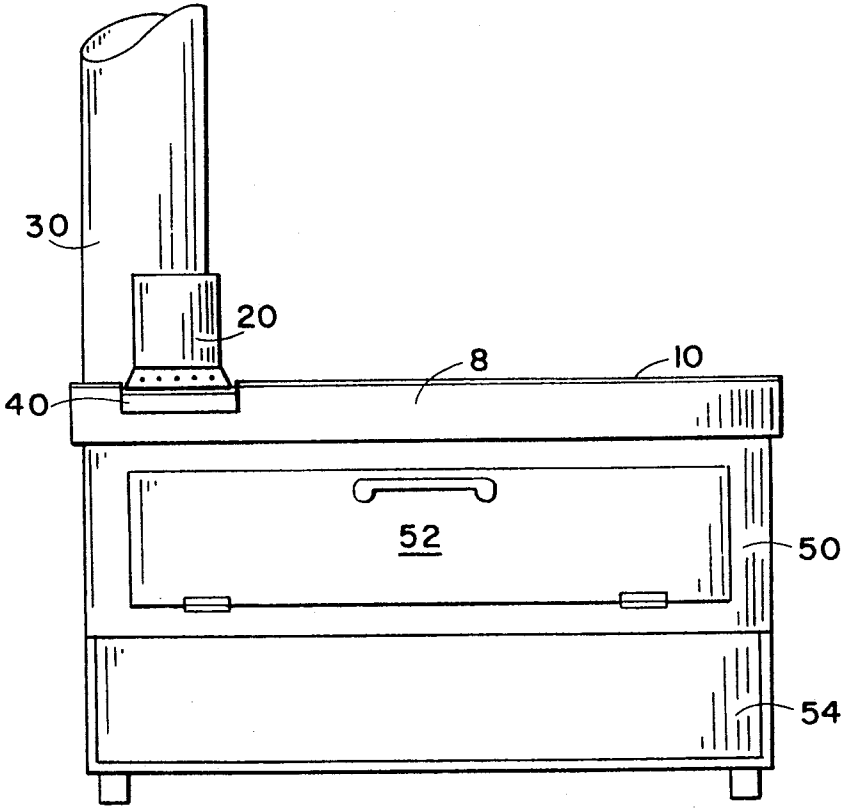
FIG. 4 is a side view of a third embodiment of the furnace.

FIG. 4 illustrates a third embodiment of the present invention where the furnace 8 is located on top of a fireproof structure, such as an oven 50, having a door 52 for gaining access to the oven 50. An open shelf 54 can be provided below the oven 50. Furnace 8 allows for mass cooking and baking to be conducted in oven 50 for mass feedings. Additionally, the barrier ring or baffle 40 can be provided within the furnace 8 around the feed aperture 25 at underside 12 of top 10 for assisting during start-up of combusting the solid fuel 2. Barrier 40 can also serve as a support for the feed chamber 20 as well as assist in channeling the air directly to the conical fuel pile 2 beneath the feed chamber 20.

Figure 5:
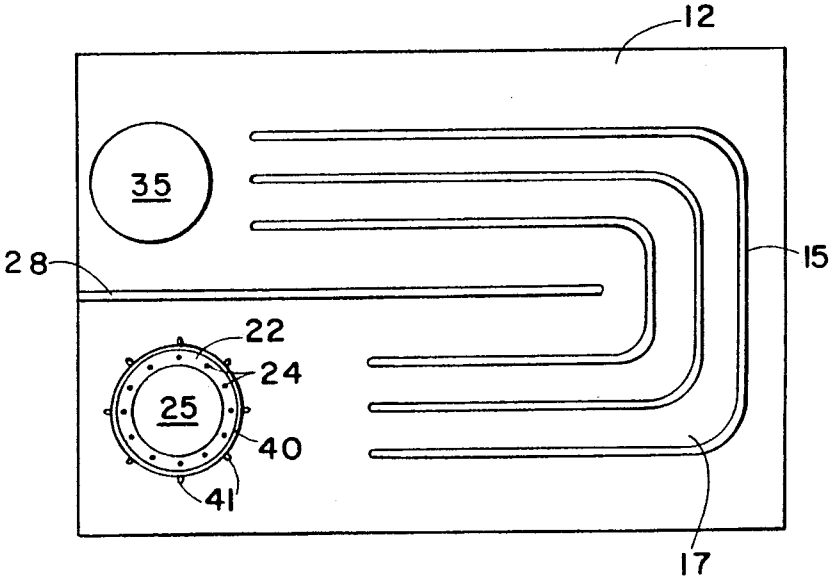
FIG. 5 is a bottom view of the furnace top of FIG. 4.

FIG. 5 illustrates a divider 28 separating the feed aperture 25 and the exhaust aperture 35. Exhaust gases are channeled from the feed aperture 25 to the exhaust aperture 35 at the underside 12 of the top 10 around the divider 28. Fins 15 are fixed to the underside 12 for channeling the exhaust gases through channels 17 around the divider 28 for providing a high capacity combustion chamber.

Figure 8:
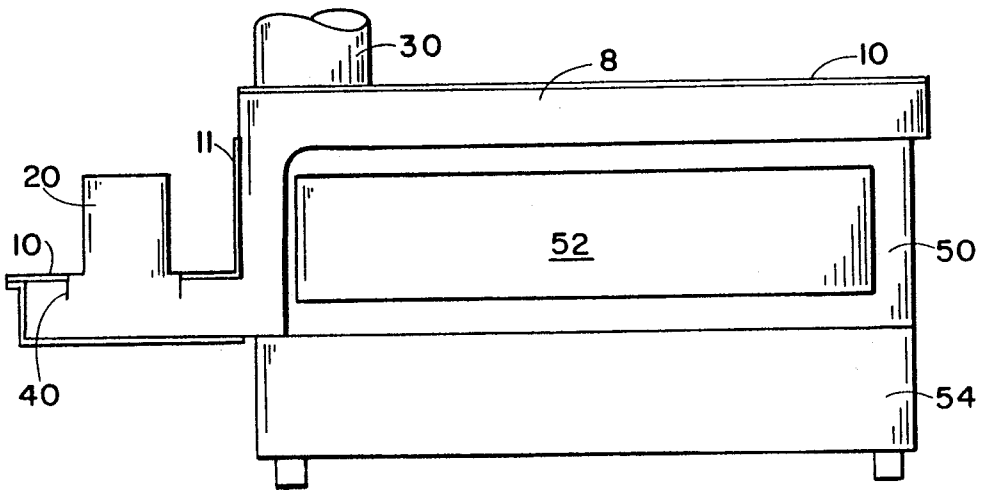
FIG. 8 is a side view of a fifth embodiment of the furnace.

FIG. 8 illustrates that the furnace 8 can comprise a horizontal low lying enclosure that is bent at right angles and placed over an oven 50. The feed chamber 20 is positioned at a location below the exhaust stack 30 on now multi-part top 10 of the furnace 8.

Figure 9:
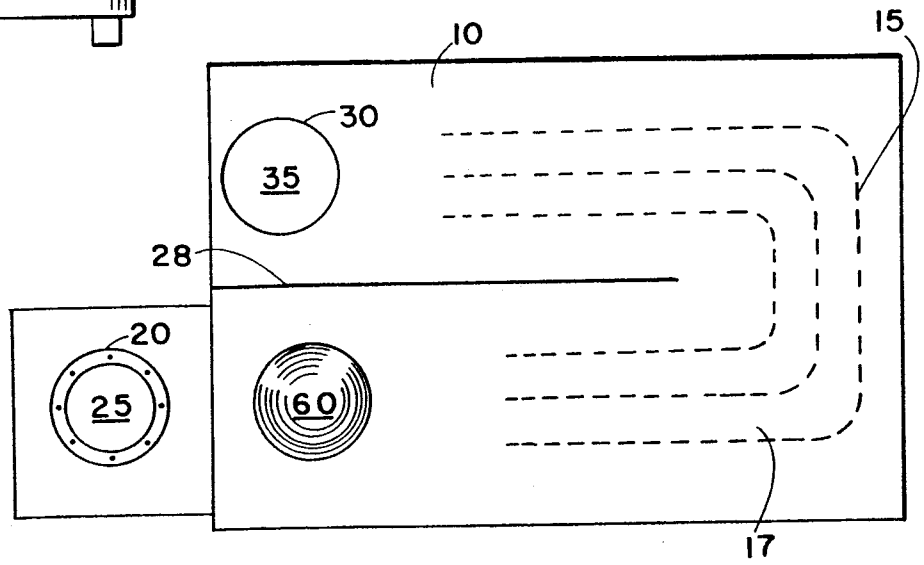
FIG. 9 is top view of a the furnace of FIG. 8.

FIG. 9 illustrates a depression 60 on an upper surface of the top 10 for allowing direct cooking on the top 10. The depression 60 is advantageously removable from top 10 and can serve as a built-in wok for facilitating mass cooking.

Figure 7:
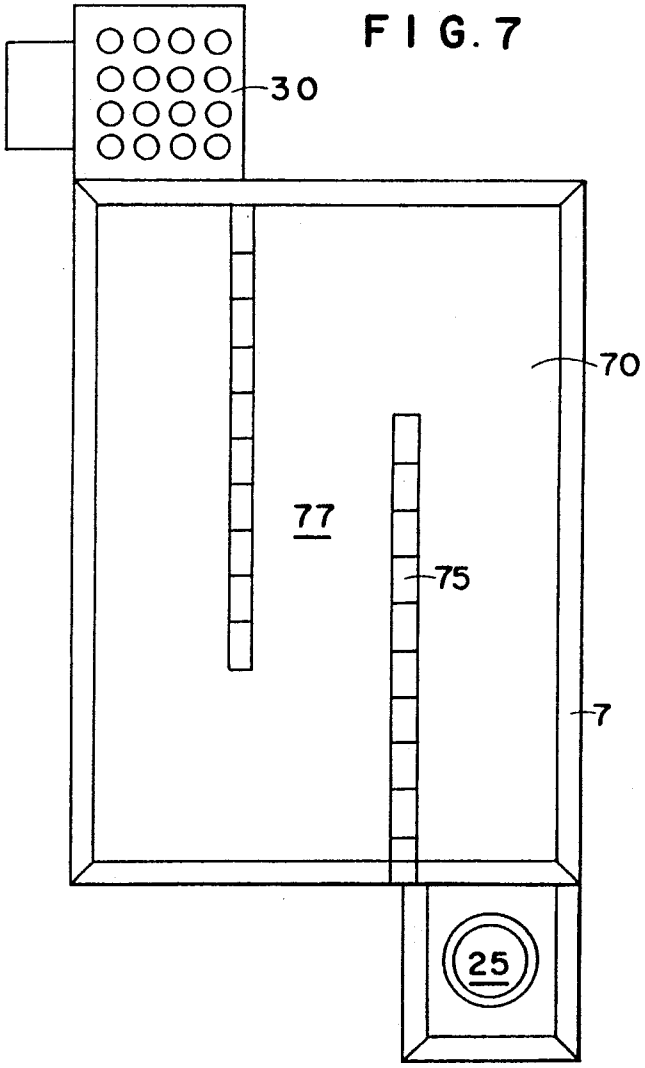
FIG. 7 is a top view, partly in cross-section of the furnace of FIG. 6.
Figure 6:
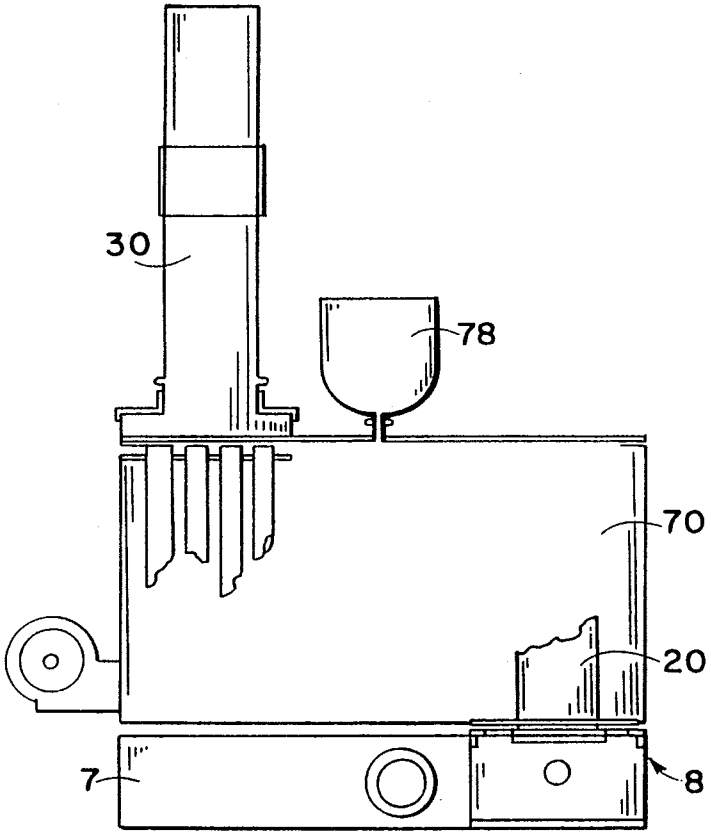
FIG. 6 is a side view of a fourth embodiment of the furnace.

FIGS. 6 and 7 illustrate another embodiment of the present invention in that a water tank 70 is supported over the furnace 8. Water tank 70 is a water tight structure for holding water and is supported within the enclosure 7 of the furnace 8. By combusting the solid fuel 2 within the enclosure 7 of the furnace 8, water is heated in the water tank 70. Water expansion and re-supply means 78 can be provided on the top surface of the tank 70 for re-supplying water to the system 70.

The bottom of tank 70 fits over or within enclosure 7 and seals enclosure 7. At the bottom surface of the bottom of the tank 70 are baffles 75, which can be brick in order to serve as fins for channeling exhaust gases within the enclosure 7 from the feeding aperture 25 to the exhaust stack 30 through channels 77. The bottom of tank 70 serves as the top for the enclosure 7.

The bottom of tank 70 fit within the enclosure 7 can be sealed by using gaskets of high temperature material. The material can be a fibrous heat resistant material such as KAOWOOL (a trademark of Babcock and Wilcox, a McDermott Company) material.

Both the feeder chamber 20 and the exhaust stack 30 can be secured to the top 10 by gravity or through securing means such as bolting or riveting. The present invention allows for the feeder chamber 20 to be removed for cleaning and servicing even when the furnace 8 is in operation. The chamber 20 remains relatively cool during the operation of the furnace 8 allowing it to be handled without utilizing gloves.

Figure 11:
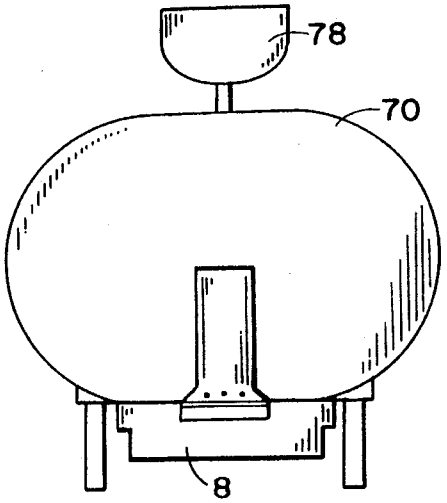
FIG. 11 is an end view thereof.
Figure 10:
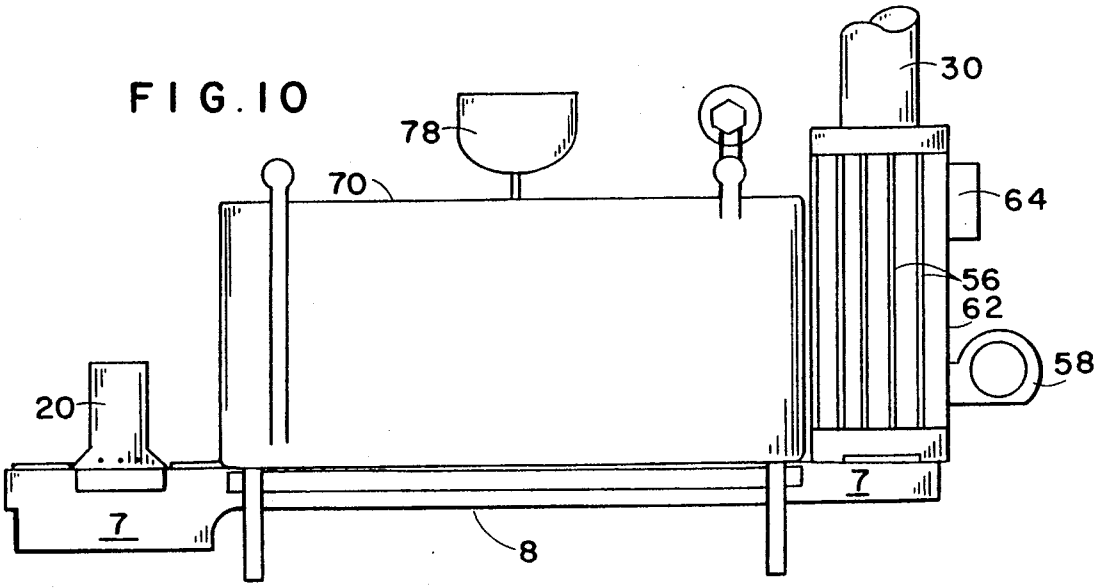
FIG. 10 is a side-elevational view of a further embodiment of the invention.
Figure 12:
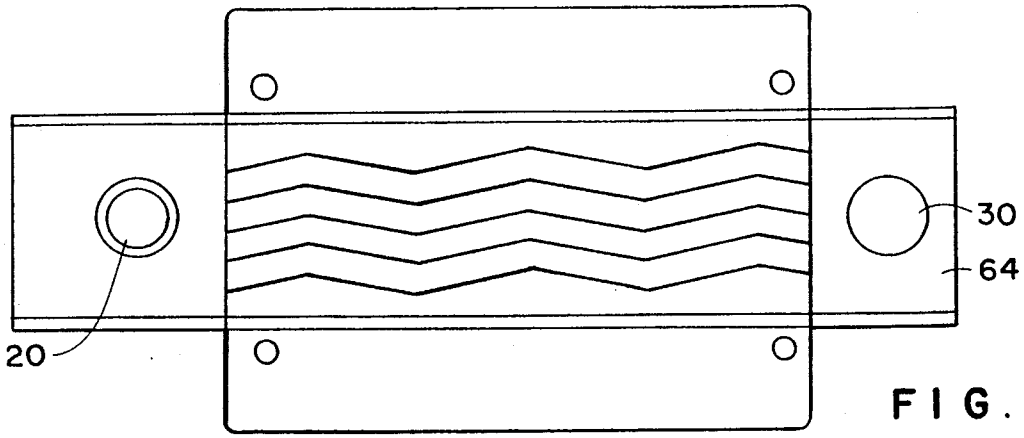
FIG. 12 is a bottom view of the fireproof top of the embodiment of FIG. 10.

FIGS. 10–12 disclose another embodiment of the invention where furnace 8 has a deeper inlet area below the feed channel 20 and a shallow section under a more conventionally-shaped water tank 70 having an expansion tank 78. As with the embodiment of FIG. 7, the furnace of FIG. 10 includes an outlet gas chamber 62 having a plurality of upwardly extending fire tubes 56 for receiving exhaust from the furnace and for channeling it to the stack 30. For additional heat recovery, a blower 58 can be blow ambient air into the enclosure for receiving heat from the fire tubes 56, the heated air being discharged through an outlet 64.

The present invention achieves a furnace 8 that achieves an operating temperature in a relatively fast manner and provides heat sufficient for cooking in about the same amount of time as conventional furnaces or stoves. Additionally, the present invention allows for food wastes to be used as fuel for burning within the furnace 8. Remaining ash from the burning of these wastes can also be recycled from the furnace 8 and used as fertilizer.

The present invention allows for a heat resistant structure such as a brick, stone or other heat resistant material structure to serve as an oven, sauna heater, etc. for use in conjunction with the horizontal furnace 8. The heat resistant structure can be provided on top of the horizontal furnace 8 or beneath the horizontal furnace 8.

While specific embodiments of the invention have been shown and described in detail to illustrate the application of the principles of the invention, it will be understood that the invention may be embodied otherwise without departing from such principles.

I claim:

1. A horizontal furnace for burning solid fuel, the furnace comprising:

a horizontally extending, shallow, fireproof enclosure;

a fireproof top closing and sealing the enclosure, the top having a feed aperture therethrough and an exhaust aperture therethrough spaced away from the feed aperture;

a vertical feed chamber having an upper open end and a lower end, the feed chamber having a lip extending outwardly from the lower open end, the chamber being connected to the top at the lip of the chamber such that the chamber is positioned over the feed aperture for allowing the solid fuel and air to be fed into the enclosure through the chamber for burning;

means for passing air onto the enclosure through the lip of the chamber for at least some combustion for burning the solid fuel;

an exhaust stack positioned over the exhaust aperture for venting exhaust from the enclosure, the exhaust stack being sufficiently tall to establish a draft so that exhaust in the enclosure passes from the feed aperture, horizontally along the enclosure, and through the exhaust aperture; and the top including a barrier fixed to an inner surface of the top and around the feed aperture, the barrier extending downwardly from the top into the enclosure.

2. A horizontal furnace for burning solid fuel, the furnace comprising:

a horizontally extending, shallow, fireproof enclosure;

a fireproof top closing and sealing the enclosure, the top having a feed aperture therethrough and an exhaust aperture therethrough spaced away from the feed aperture;

a vertical feed chamber having an upper open end and a lower end, the feed chamber having a lip extending outwardly from the lower open end, the chamber being connected to the top at the lip of the chamber such that the chamber is positioned over the feed aperture for allowing the solid fuel and air to be fed into the enclosure through the chamber for burning;

means for passing air onto the enclosure through the lip of the chamber for at least some combustion for burning the solid fuel;

an exhaust stack positioned over the exhaust aperture for venting exhaust from the enclosure, the exhaust stack being sufficiently tall to establish a draft so that exhaust in the enclosure passes from the feed aperture, horizontally along the enclosure, and through the exhaust aperture; and means within the furnace for diverting and directing exhaust from the feed aperture to the exhaust aperture, said means within the furnace for directing exhaust comprising a plurality of elongated fins fixed to an inner surface of the top for channeling the exhaust from the feed aperture to the exhaust aperture.

3. A horizontal furnace for burning solid fuel, the furnace comprising:

a horizontally extending, shallow, fireproof enclosure;

a fireproof top closing and sealing the enclosure, the top having a feed aperture therethrough and an exhaust aperture therethrough spaced away from the feed aperture;

a vertical feed chamber having an upper open end and a lower end, the feed chamber having a lip extending outwardly from the lower open end, the chamber being connected to the top at the lip of the chamber such that the chamber is positioned over the feed aperture for allowing the solid fuel and air to be fed into the enclosure through the chamber for burning;

means for passing air onto the enclosure through the lip of the chamber for at least some combustion are for burning the solid fuel;

an exhaust stack positioned over the exhaust aperture for venting exhaust from the enclosure, the exhaust stack being sufficiently tall to establish a draft so that exhaust in the enclosure passes from the feed aperture, horizontally along the enclosure, and through the exhaust aperture; and wherein the top has a depression on an upper surface of the top.

4. The furnace according to claim 1, including means within the furnace for diverting and directing exhaust from the feed aperture to the exhaust aperture.

5. The furnace according to claim 1, wherein the top is a continuous plate.

6. The furnace according to claim 1, wherein the top comprises a plurality of connected plates.

7. The furnace according to claim 1, wherein the means for passing air into the enclosure through the lip is a plurality of openings in the lip.

8. The furnace according to claim 2, wherein the shallow enclosure is a fireproof box.

9. The furnace according to claim 8, wherein the furnace includes means within the furnace for directing exhaust from the feed aperture to the exhaust aperture.

10. The furnace according to claim 1, including a plurality of brick baffles in the enclosure for channeling the exhaust from the feed aperture to the exhaust aperture.

11. The furnace according to claim 8, wherein the fireproof box is supported on top of a fireproof structure for use as an oven.

* * * * *